US009204729B2

(12) United States Patent
Frankel et al.

(10) Patent No.: US 9,204,729 B2
(45) Date of Patent: Dec. 8, 2015

(54) MATCHED FOOTREST RACK FOR FOLDING SEAT

(71) Applicant: Zenithen USA, LLC, Diamond Bar, CA (US)

(72) Inventors: Andrew David Frankel, Yorba Linda, CA (US); Shi-Ping Zheng, Fuzhou (CN)

(73) Assignee: ZENITHEN USA, LLC, Diamond Bar, CA (US)

( * ) Notice: Subject to any disclaimer, the term of this patent is extended or adjusted under 35 U.S.C. 154(b) by 18 days.

(21) Appl. No.: 13/959,815

(22) Filed: Aug. 6, 2013

(65) Prior Publication Data

US 2015/0042144 A1 Feb. 12, 2015

(51) Int. Cl.

| | |
|---|---|
| ***A47C 7/50*** | (2006.01) |
| ***A47C 1/14*** | (2006.01) |
| ***A47C 5/10*** | (2006.01) |

(52) U.S. Cl.

CPC ... *A47C 7/50* (2013.01); *A47C 1/14* (2013.01); *A47C 5/10* (2013.01)

(58) Field of Classification Search

USPC ..... 297/423.3, 423.26, 42, 45, 423.28, 297/423.4

See application file for complete search history.

(56) References Cited

U.S. PATENT DOCUMENTS

| | | | | | |
|---|---|---|---|---|---|
| 909,411 | A * | 1/1909 | Hockney | 297/45 |
| 1,400,625 | A * | 12/1921 | Rawlinson | 297/423.32 |
| 2,414,856 | A * | 1/1947 | Cox | 297/423.4 |
| 3,072,433 | A * | 1/1963 | Heller et al. | 297/40 |
| 4,359,244 | A * | 11/1982 | Koehm | 297/16.2 |
| 4,583,758 | A * | 4/1986 | Runion et al. | 280/644 |
| 5,156,441 | A * | 10/1992 | Byersmith et al. | 297/423.28 |
| 5,918,942 | A * | 7/1999 | Olsen | 297/423.32 |
| 6,095,610 | A * | 8/2000 | Okajima et al. | 297/423.36 |
| 6,155,645 | A * | 12/2000 | Bedrich | 297/423.28 |
| 6,170,907 | B1 * | 1/2001 | Tsai | 297/16.1 |
| 6,209,951 | B1 * | 4/2001 | Han | 297/45 |
| 6,382,727 | B1 * | 5/2002 | Pickard | 297/423.36 |
| 6,517,160 | B2 * | 2/2003 | Marcantoni | 297/423.36 |
| 6,585,279 | B1 * | 7/2003 | Galloway et al. | 280/304.1 |
| 6,685,271 | B1 * | 2/2004 | Chang | 297/423.4 |
| 6,692,068 | B1 * | 2/2004 | Tang | 297/16.2 |
| 6,773,073 | B1 * | 8/2004 | Escobedo | 297/423.34 |
| 6,902,231 | B1 * | 6/2005 | Tseng | 297/27 |
| 7,017,984 | B2 * | 3/2006 | Chen | 297/45 |
| 7,121,627 | B2 * | 10/2006 | Gaikwad et al. | 297/423.36 |
| 7,229,134 | B2 * | 6/2007 | Ito | 297/423.26 |
| 7,360,841 | B2 * | 4/2008 | Barlow et al. | 297/423.36 |
| 7,429,083 | B2 * | 9/2008 | Tsuji et al. | 297/423.26 |
| 7,445,291 | B2 * | 11/2008 | Parkel et al. | 297/423.1 |
| 7,607,725 | B2 * | 10/2009 | Dickie et al. | 297/45 |
| 7,628,450 | B2 * | 12/2009 | Castagnola et al. | 297/38 |

(Continued)

*Primary Examiner* — David R Dunn
*Assistant Examiner* — Alexander Harrison
(74) *Attorney, Agent, or Firm* — Merek, Blackmon & Voorhees, LLC

(57) ABSTRACT

The present invention relates to a matched footrest rack for a folding seat, which comprises a pair of landing rods intersected and hinged together as well as a pair of support rods intersected and hinged together. The matched footrest rack for a folding seat is characterized in that one end of each of the two landing rods is hinged at two landing legs corresponding to a front vertical face of the folding seat. The two landing rods can be turned over towards the inner side or the outer side of the front vertical face of the folding seat synchronously with the help of a hinge point so as to form a folding or opening state. The footrest rack has the characteristics of being extended in the deployed position for support and compact when the footrest rack is folded.

5 Claims, 6 Drawing Sheets

(56) References Cited

U.S. PATENT DOCUMENTS

| | | | | |
|---|---|---|---|---|
| 7,641,276 | B1 * | 1/2010 | Chen | 297/42 |
| 7,918,496 | B2 * | 4/2011 | Mackert | 297/75 |
| 8,322,791 | B2 * | 12/2012 | Port | 297/423.39 |
| 8,403,420 | B2 * | 3/2013 | Billescas | 297/423.19 |
| 8,444,225 | B2 * | 5/2013 | Behe | 297/423.26 |
| 8,496,289 | B2 * | 7/2013 | Chen et al. | 297/42 |
| 8,523,282 | B2 * | 9/2013 | Wu | 297/423.3 |
| 8,646,835 | B2 * | 2/2014 | Homans et al. | 297/16.2 |
| 8,651,569 | B2 * | 2/2014 | Andoloro et al. | 297/195.11 |
| 8,794,706 | B2 * | 8/2014 | Lin | 297/423.28 |
| 8,864,220 | B2 * | 10/2014 | Kim | 297/19 |
| 8,876,212 | B2 * | 11/2014 | Yamada et al. | 297/411.32 |
| 8,991,920 | B2 * | 3/2015 | Oren et al. | 297/274 |
| 2003/0006632 | A1 * | 1/2003 | Ku | 297/45 |
| 2003/0075966 | A1 * | 4/2003 | Behnert | 297/423.26 |
| 2004/0036331 | A1 * | 2/2004 | Jonasson | 297/250.1 |
| 2004/0075327 | A1 * | 4/2004 | Adams | 297/423.4 |
| 2007/0001502 | A1 * | 1/2007 | Welsh et al. | 297/423.4 |
| 2010/0244534 | A1 * | 9/2010 | Driessen et al. | 297/423.35 |
| 2012/0032490 | A1 * | 2/2012 | Nowak et al. | 297/423.3 |
| 2013/0292987 | A1 * | 11/2013 | Doucette et al. | 297/423.3 |

* cited by examiner

MATCHED FOOTREST RACK FOR FOLDING SEAT

FIELD OF THE INVENTION

The present invention according to at least one embodiment belongs to the field of folding seats, and in particular relates to a footrest rack capable of being matched to a folding seat. The footrest rack can be integrally associated with the folding seat to provide the requirement for placing feet.

DESCRIPTION OF RELATED ART

The standard existing folding seat shown by way of example is a beach chair. The chair has a high folding function, and is widely popular. The seat and is foldable provides for a seating surface for sitting and resting. The folding seat allows the user to sit and rest with an optional footrest. However, most folding seats are designed in an integrated manner. The footrest rack and a backrest rack are designed with a linkage manner. The footrest rack is folded to the front vertical face of the seat, but usually occupies the space of where both feet would be placed. People can easily trip and fall while taking a seat, so that the footrest rack inhibits good safety and is universality poorly configured. The folding seats also must have various shapes as required to fit with different chairs. One such folding footrest for a folding seat is disclosed in the Chinese patent CN201528858U, which is incorporated herein by reference. The footrest is capable of being assembled on the folding seat. The footrest comprises a connecting bracket, a support frame and a footrest surface, wherein the connecting bracket comprises two connecting tubes which are intersected and rotatably connected to form an X shape. One end of the connecting bracket is rotatably connected with a support leg of the folding seat and the other end is rotatably connected with the support frame. The support frame comprises two support tubes which are intersected and rotatably connected to form an X shape. The footrest surface is arranged on the support frame, and the intersecting point of the support tubes is connected with the intersecting point of the connecting tubes through a pull cord so that the footrest can't being kicked over by the feet.

When the footrest is used, the connecting bracket is turned over to prop up the support frame, and the footrest surface is naturally opened. During the folding operation, the support frame is turned over and folded on the connecting bracket, then the support frame and the connecting bracket are turned over upwards, and the footrest is completely placed under the seat portion of the folding seat. The footrest provides a train of thought, but the structure has the following defects: Firstly, if the support frame and the connecting bracket want to be turned under the seat of the folding seat integrally, the heights and lengths of the support frame and the connecting brackets are both restricted, and the footrest cannot support the both of the user's feet after the footrest is opened. Secondly, the support frame is provided with an independent footrest surface, and the footrest surface has relatively poor stability since the footrest surface is only supported by two support tubes, so that the possibility of unwanted left to right movement or overturning can be generated by unbalanced forces exerted. And thirdly, the support frame is associated with the connecting bracket through a pull cord, and the problem of poor stability still exists. The objects researched by the utility model improve the disadvantages in the prior art, and a practical footrest rack with practicability is taught.

SUMMARY OF THE INVENTION

One purpose of the utility model is to design a matched footrest rack for a folding seat, in which support rods are connected with landing roads through universal joints. The support rods can be vertically folded towards a front vertical face of the folding seat along with the landing rod, and the footrest shell fabric is fixed between the upper ends of the two support rods and the vertical face of the folding seat.

The technical scheme of at least one embodiment of the utility model is realized as follows: the matched footrest rack for the folding seat comprises a pair of landing rods intersected and hinged together and a pair of support rods intersected and hinged together. The matched footrest rack for the folding seat is characterized in that one end of each of the two landing rods is hinged at the two landing legs corresponding to the front vertical face of the folding seat. The two landing rods can be turned over towards the inner side or the outer side of the front vertical face of the folding seat in synchronization with the aid of a hinge point so as to form a folding or opening state. The other end of the landing rod is mutually hinged with one end of the support rod through a universal joint, and the support rods can be turned over inwardly or outwardly along with the landing rods with the help of the universal joints. The other end of the support rod is fixed with one end of footrest shell fabric, and the other end of the footrest shell fabric is fixed on the front vertical face of the folding seat. Namely, the other end of the footrest shell fabric is integrally connected with the front end of cushion shell fabric of the folding seat or fixed on the front vertical face of the folding seat, and the hinge joints are movable hinge joints.

The universal joint is a hinge piece. The hinge piece is provided with a horizontal fixed surface and a vertical fixed surface which are vertical to each other. The landing rods are hinged on the horizontal fixed surface through linear rivets. The support rods are fixed on the vertical fixed surface through a right angle rivet or a U-shaped piece and linear rivets.

A guide shaft is penetrated between the vertical fixed surfaces of two hinge pieces at the ends of the landing rod. The synchronization of the actions of the two hinge pieces is maintained with the help of the guide shaft.

The universal joint is a ball head connecting piece. The ball head connecting piece comprises an outer ball head and an inner ball head. The outer ball head is movably positioned on the end surface of the landing rod. The inner ball head is movably hinged at the end of the support rod through the U-shaped piece.

A leaf spring is fixed on the support rod close to the hinge point. The leaf spring can abut against the hinge piece or the ground surface when the landing rods are turned inwards in place, so that the trending that the support rods are close to the front vertical face of the folding seat is kept.

The matched footrest rack for the folding seat is more practical in structure than the prior art devices with its relatively long support rods. The footrest shell fabric can extend further so as to meet the requirement of placing both feet on the footrest. The support rods opened outwardly. The folding seat forms an opposite pulling structure with the help of the footrest shell fabric so as to ensure the stability of the footrest rack. The use of the universal joints meets the requirement that the landing rods can be flexibly turned over about 180 degrees so as to facilitate folding and opening operations. The folded footrest rack is tightly attached to the front vertical face of the folding seat so that the space in front is not occupied and people don't trip. During the folding operation of the footrest rack, only the support rods are required to be pulled without requiring the user get up so that the landing rods are turned over with 180 degrees allowing the user the choice of sitting or lying. The footrest rack can be matched with any folding seat with footrest on the front vertical face for use.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

Combined with concrete diagram examples, further description of the utility model is as follows.

Figure 1:
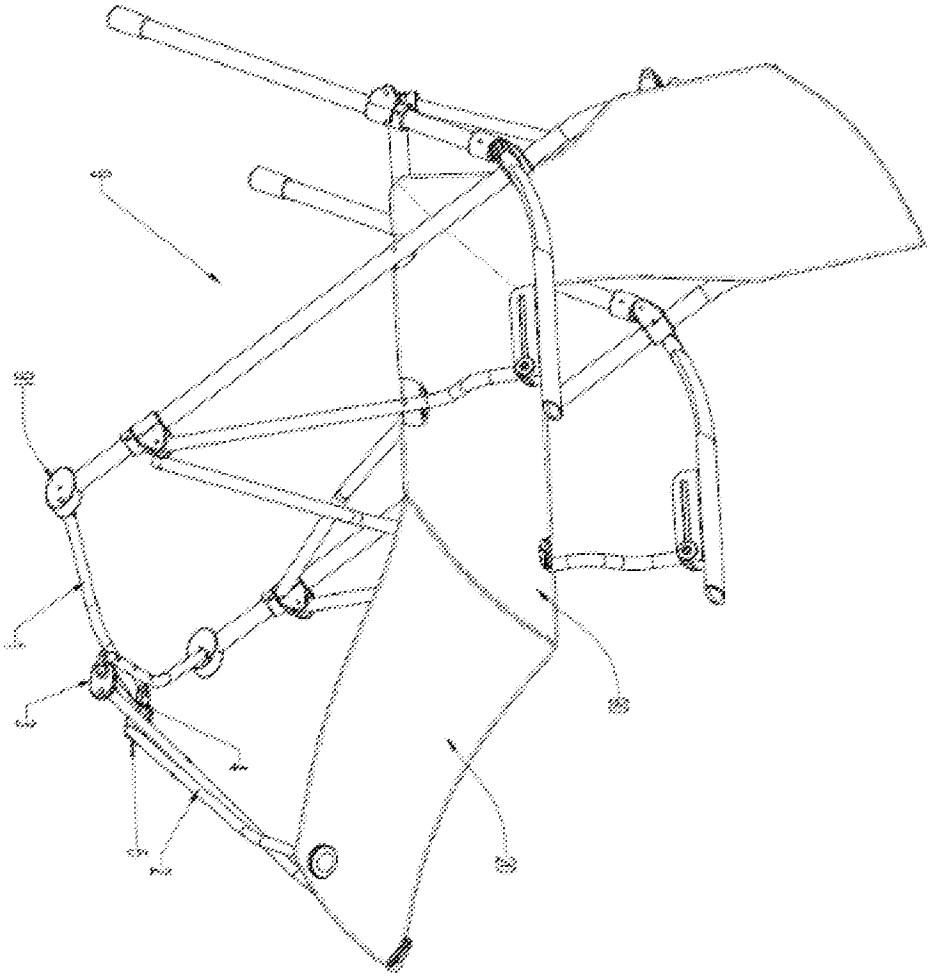
FIG. 1 a diagram of opening state of the folding seat with the footrest rack FIG. 2 a diagram of opening state of the bracket of the folding seat with the footrest rack FIG. 3 a diagram of inward folding state of the footrest rack of the folding seat FIG. 4 a relation diagram of hinge pieces and rivets FIG. 5 a diagram of outwards overturning support state of the footrest rack FIG. 6 a diagram of inwards overturning folding state of the footrest rack FIG. 7 a diagram of support state of the footrest rack of the ball head connecting piece FIG. 8 a diagram of local decomposition of the footrest rack of the ball head connecting piece FIG. 9 a diagram of folding state of the footrest rack Wherein, the following items are described.
Figure 2:
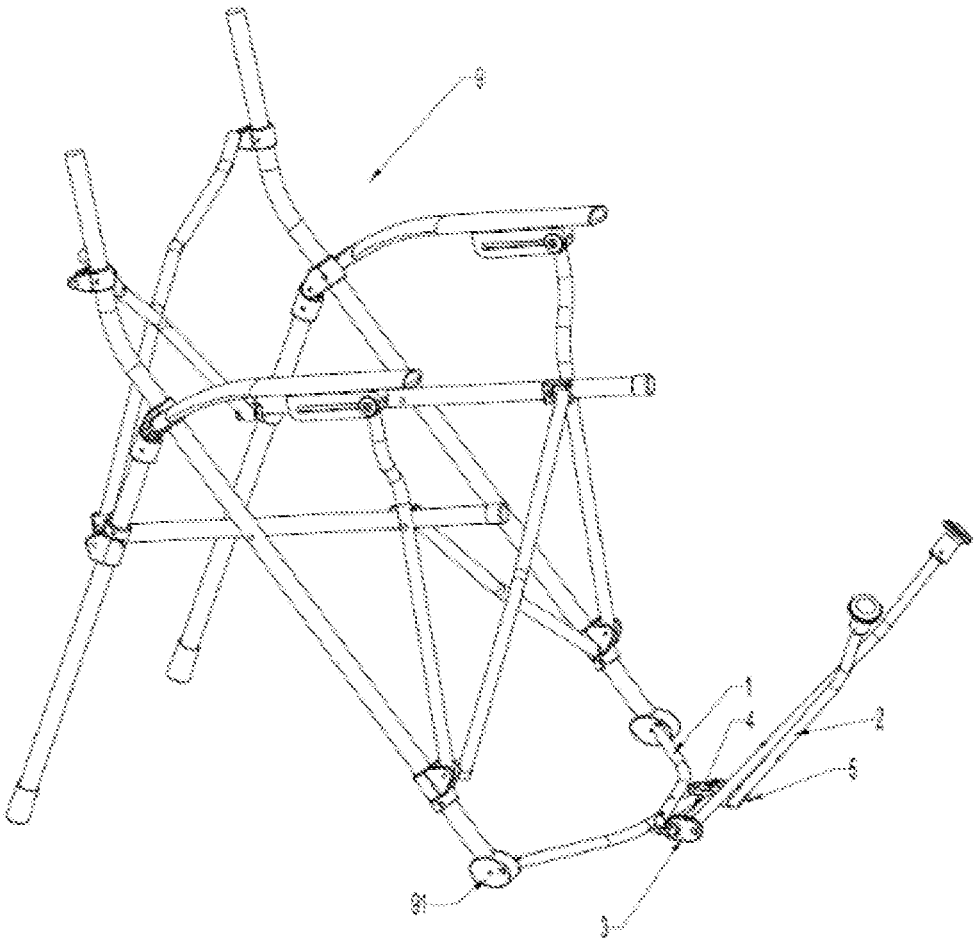
Figure 3:
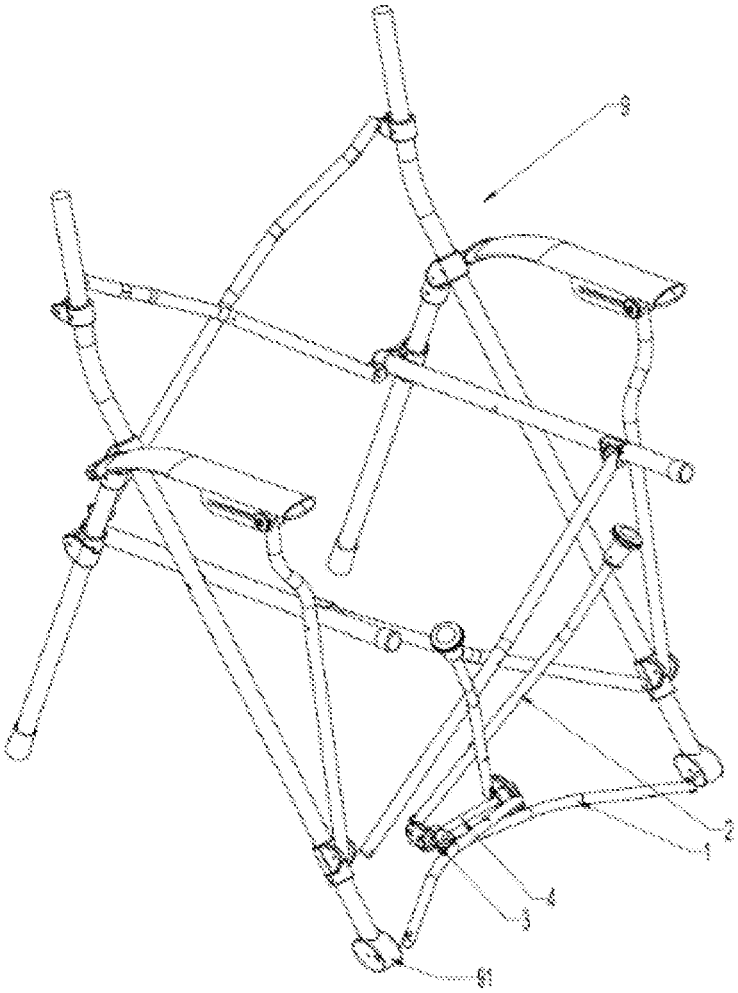
Figure 4:
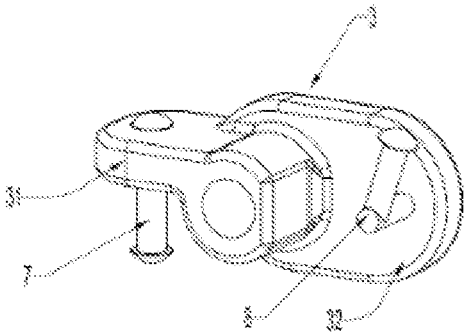
Figure 5:
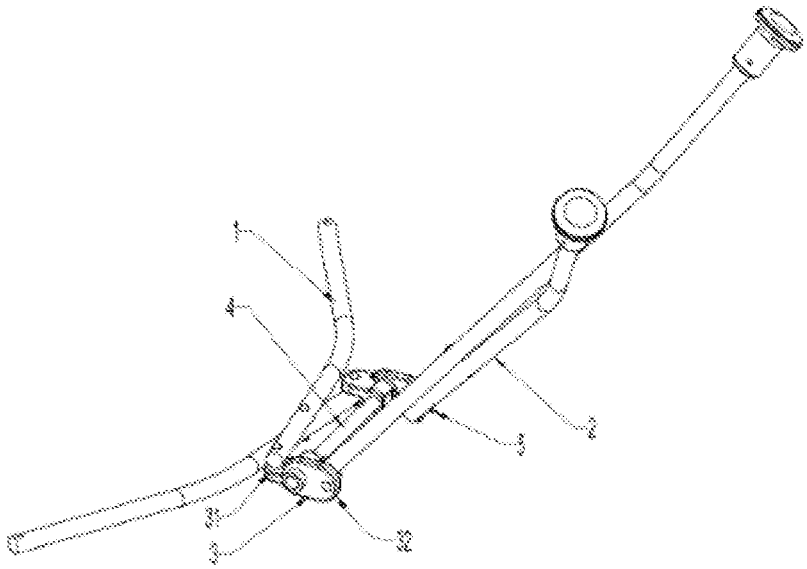
Figure 6:
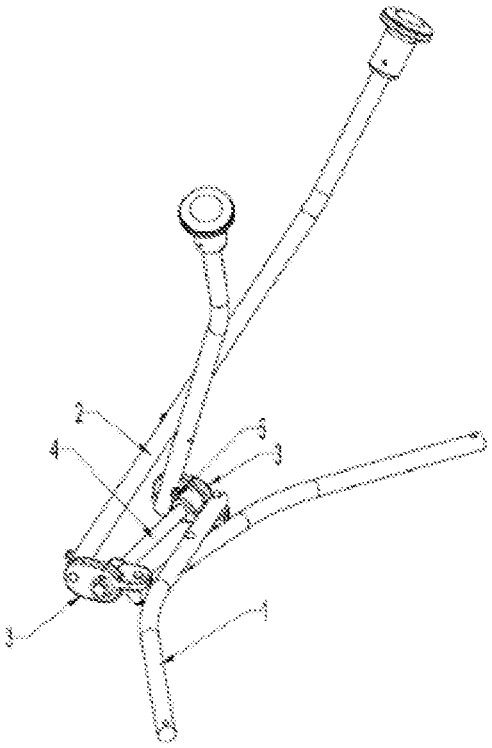

A. 1—landing rod
B. 2—support rod
C. 20—footrest shell fabric
D. 3—hinge piece
E. 31—horizontal fixed surface
F. 32—vertical fixed surface
G. 4—guide shaft
H. 5—left spring
I. 6—ball head connecting piece
J. 61—outer ball head
K. 62—inner ball head
L. 63—U-shaped piece
M. 7—linear rivet
N. 8—right angle rivet
O. 9—folding seat
P. 90—cushion shell fabric
Q. 91—landing leg Similar reference characters denote corresponding features consistently throughout the attached drawings.

DETAILED DESCRIPTION OF THE PREFERRED EMBODIMENT(S)

First Embodiment(s) of the Invention

As best shown in FIG. 1 to FIG. 6, the matched footrest rack for the folding seat comprises a pair of landing rods 1 intersected and hinged together, and a pair of support rods 2 intersected and hinged together. One end of each of the two landing rods 1 is hinged at two landing legs 91 corresponding to the front vertical face of the folding seat 9, concretely movably hinged at the landing legs 91 through right angle rivets 8 or U-shaped pieces and linear rivets. The two landing rods 1 can be turned over towards the inner side or the outer side of the front vertical face of the folding seat 9 synchronously with the help of a hinge point so as to form a folding or opening state.

The other end of the landing rod 1 is mutually hinged with one end of the support rod 2 through a universal joint. The support rods 2 can be turned over inwardly or outwardly along with the landing rods 1 with the aid of the universal joints. In the diagrammed example, the universal joint is a hinge piece 3. The hinge piece 3 is provided with a horizontal fixed surface 31 and a vertical fixed surface 32 which are vertical to each other.

The landing rods 1 are hinged on the horizontal fixed surface 31 through linear rivets 7 and can be folded flexibly along with the horizontal fixed surface 31. The support rods 2 are fixed on the vertical fixed surface 32 through a right angle rivet 8 or a U-shaped piece and linear rivets, so that the support rods can swing along the vertical fixed surface 32 to counter the overturning action along with the landing rods so that the folding and opening actions between the two support rods are not influenced. In order to coordinate the actions of the two hinge pieces 32 and cause the footrest rack to open and fold synchronously, a guide shaft 4 is penetrated between the vertical fixed surfaces 32 of two hinge pieces, and the synchronization of the actions of the two hinge pieces 3 is kept with the help of the guide shaft 4.

Moreover, a leaf spring is 5 fixed on the support rod 2 close to the hinge point. The leaf spring 5 can abut against the hinge piece 3 when the landing rods 1 are turned inwardly in place, so that the proximity of the support rods 2 close to the front vertical face of the folding seat 9 is maintained. The support rods are prevented from being turned over to influence the use because they are unrestricted.

As shown in FIG. 1, the other end of the support rod 2 is fixed with one end of footrest shell fabric 20. The other end of the footrest shell fabric 20 is fixed on the front vertical face of the folding seat 9. The other end of the footrest shell fabric is integrally connected with the front end of cushion shell fabric 90 of the folding seat 9, or fixed on the front vertical face of the folding seat 9, or fixed on a support rod piece or an upper leg disk on the front vertical face.

In at least one aspect of the invention, the support rod 2 can be lengthened. When the support rods are turned over forwards, the distance between the support rods can be lengthened so as to be out of the way while the user stands. During operation, only the support rods are required to be pulled to drive the landing rods 1 to turn over outwardly from the front vertical face of the folding seat together. Because of the dead weight of the support rods 2, the footrest shell fabric 20 is naturally stretched tightly, and the footrest rack cannot be turned over backwards since the support rods are inclined forwards after the feet are placed on them.

When the footrest is not required, the operation is carried out in the opposite order. Namely, the support rods 2 are pulled to drive the landing rods 1 to turn over inwardly while the footrest rack is positioned. The support rods 2 are tightly attached to the inner space of the front vertical face or the front vertical face under the force of the leaf spring 5 so that people don't trip. Alternatively, a simple folding manner can be adopted, where the support rods 2 are directly placed at the front vertical face of the folding seat, so that the occupied space of the front vertical face of the folding seat can be greatly reduced. The above operations can be carried out when seating, and can be carried out just by pressing against the legs, so that the user's experience is greatly enhanced.

Further Embodiment of the Invention

Figure 7:
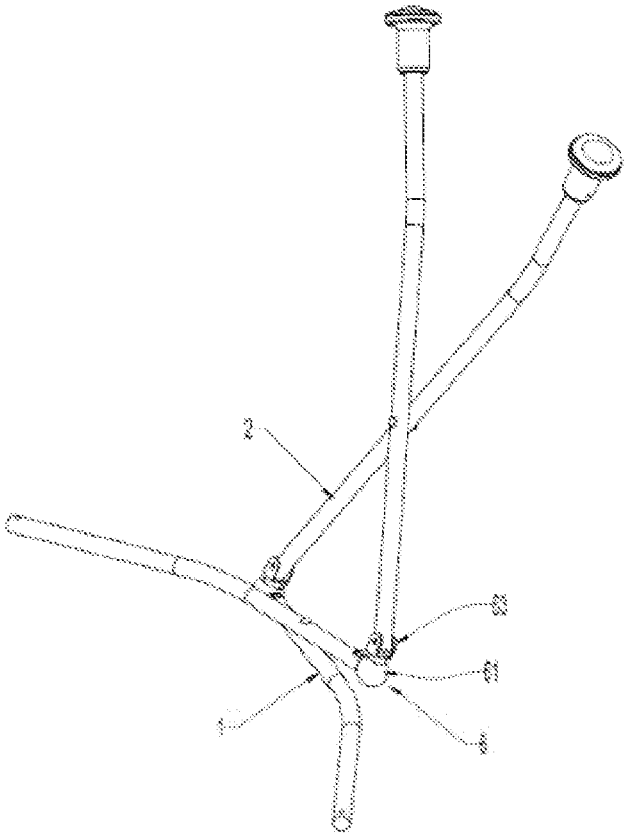
Figure 8:
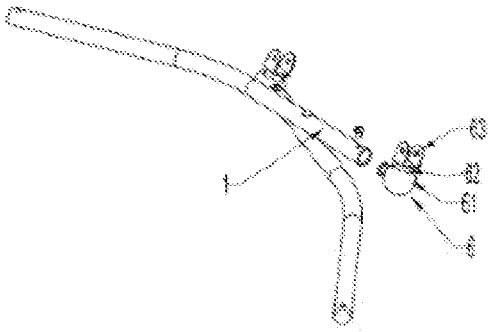
Figure 9:
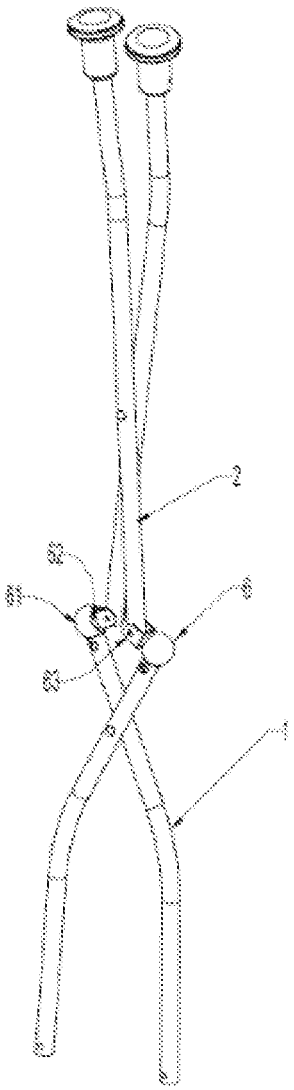

As best seen with regard to FIG. 7, FIG. 8 and FIG. 9, the universal joints can be formed as a ball head connecting piece 6 selectively. The ball head connecting piece 6 is a standard joint and comprises an outer ball head 61 and an inner ball head 62. The outer ball head 61 is movably positioned on the end surface of the landing rod 1 and can rotate relative to the landing rods 1 so that the landing rods 2 resist an overturning action. The inner ball head 62 is movably hinged at the end of the support rod 2 through the U-shaped piece, so that the angle of the support rods 2 can be adjusted relative to the inner ball head 62 when the support rods are folded. As shown in FIG. 9, the footrest rack is reduced in volume after being folded and can be integrated with the folding seat without occupying much space. The footrest rack also can be matched with any folding seat so as to realize the footrest function.

Moreover, in the scheme, a leaf spring 5 is still arranged on the support rod 2. The leaf spring 5 can abut against the ground surface when the landing rods 1 are turned inwardly in place, so that proximity of the support rods 2 next to the front vertical face of the folding seat 9 is maintained. The support rods are prevented from being turned over because of their unrestricted motion.

All of the above hinges are movable hinges, so that each part can swing around each hinge point flexibly so as to realize opening and folding functions.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A matched footrest rack for a folding seat, comprising:

a pair of landing rods intersected and hinged together and a pair of support rods intersected and hinged together, characterized in that one end of each of the two landing rods is hinged at two landing legs corresponding to a front vertical face of the folding seat, and the two landing rods can be turned over towards the inner side or the outer side of the front vertical face of the folding seat synchronously with the help of a hinge point so as to form a folding or opening state;

the other end of the landing rod is mutually hinged with one end of the support rod through a universal joint, and the support rods can be turned over inwards or outwards along with the landing rods with the help of the universal joints;

the other end of the support rod is fixed with one end of footrest shell fabric, the other end of the footrest shell fabric is fixed on the front vertical face of the folding seat, concretely namely the other end of the footrest shell fabric is integrally connected with the front end of cushion shell fabric of the folding seat or fixed on the front vertical face of the folding seat; and the hinge joints are movable hinge joints;

wherein the universal joint is a hinge piece, the hinge piece is provided with a horizontal fixed surface and a vertical fixed surface which are vertical to each other, the landing rods are hinged on the horizontal fixed surface through linear rivets, and the support rods are fixed on the vertical fixed surface through a right angle rivet or a U-shaped piece and linear rivets.

2. The matched footrest rack for the folding seat according to claim 1, characterized in that a guide shaft is penetrated between the vertical fixed surfaces of two hinge pieces at the end of the landing rod, and the synchronization of the actions of the two hinge pieces is kept with the help of the guide shaft.

3. The matched footrest rack for the folding seat according to claim 1, characterized in that a leaf spring is fixed on the support rod close to the hinge point, and the leaf spring can abut against the hinge piece or the ground surface when the landing rods are turned inwards in place, so that the trending that the support rods are close to the front vertical face of the folding seat is kept.

4. A matched footrest rack for a folding seat, comprising:

a pair of landing rods intersected and hinged together and a pair of support rods intersected and hinged together, characterized in that one end of each of the two landing rods is hinged at two landing legs corresponding to a front vertical face of the folding seat, and the two landing rods can be turned over towards the inner side or the outer side of the front vertical face of the folding seat synchronously with the help of a hinge point so as to form a folding or opening state;

the other end of the landing rod is mutually hinged with one end of the support rod through a universal joint, and the support rods can be turned over inwards or outwards along with the landing rods with the help of the universal joints;

the other end of the support rod is fixed with one end of footrest shell fabric, and the other end of the footrest shell fabric is fixed on the front vertical face of the folding seat, concretely namely the other end of the footrest shell fabric is integrally connected with the front end of cushion shell fabric of the folding seat or fixed on the front vertical face of the folding seat; and the hinge joints are movable hinge joints;

a leaf spring fixed on the support rod close to the hinge point, and the leaf spring can abut against the hinge piece or the ground surface when the landing rods are turned inwards in place, so that the trending that the support rods are close to the front vertical face of the folding seat is kept.

5. The matched footrest rack for the folding seat according to claim 4, characterized in that a leaf spring is fixed on the support rod close to the hinge point, and the leaf spring can abut against the hinge piece or the ground surface when the landing rods are turned inwards in place, so that the trending that the support rods are close to the front vertical face of the folding seat is kept.

* * * * *